US007159438B2

(12) United States Patent
Lauke et al.

(10) Patent No.: US 7,159,438 B2
(45) Date of Patent: Jan. 9, 2007

(54) TRANSFER PRESS WITH IMPROVED USE OF SPACE

(75) Inventors: Andreas Lauke, Gruibingen (DE); Karl Thudium, Wäschenbeuren (DE); Gerd Jäger, Bad Öberkingen (DE); Hans Hofele, Göppingen (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 89 days.

(21) Appl. No.: 10/875,738

(22) Filed: Jun. 25, 2004

(65) Prior Publication Data

US 2004/0261488 A1 Dec. 30, 2004

(30) Foreign Application Priority Data

Jun. 25, 2003 (DE) ..... 103 28 447

(51) Int. Cl.
*B21D 43/05* (2006.01)

(52) U.S. Cl. ..... 72/405.11; 72/405.1; 72/405.01; 414/752.1; 198/621.1

(58) Field of Classification Search ..... 72/405.01, 72/405.1, 405.09, 405.05, 405.11; 414/752.1; 198/621.1

See application file for complete search history.

(56) References Cited

U.S. PATENT DOCUMENTS 4,411,587 A * 10/1983 Niki ..... 198/750.13
4,487,409 A * 12/1984 Orii ..... 271/267
5,012,665 A 5/1991 Brandstetter
5,106,258 A * 4/1992 Orii ..... 414/733
5,140,839 A 8/1992 Bruns
5,337,594 A * 8/1994 Pettersson et al. ..... 72/446
5,452,981 A * 9/1995 Crorey et al. ..... 198/468.6
6,712,198 B1 3/2004 Harsch
6,715,981 B1 * 4/2004 Harsch et al. ..... 414/752.1

FOREIGN PATENT DOCUMENTS

DE 195 21 976 12/1995
DE 196 28 556 1/1998
DE 100 42 991 3/2002
WO WO 00/54904 * 9/2000

* cited by examiner

*Primary Examiner*—Daniel C. Crane
(74) *Attorney, Agent, or Firm*—Fitch, Even, Tabin & Flannery; Norman N. Kunitz

(57) ABSTRACT

A transfer press provided with a transfer device, having transfer units provided with cross members (37) for which the length is shorter than the width of a tool. The transfer units (29 to 32) are arranged completely between the processing stations or stages, are mounted on the crown or head piece, and are not provided with elements extending beside the tools or between supports of adjacent processing or press stations. Thus, the full width spanned by the press supports can be used for the tools. In addition, tools can be used which are provided with guides, effective between the upper tool and the lower tool, particularly in the side region. The work pieces are handled solely by means of the openings, freed by the tools and pointing counter to the transporting device, wherein no element of the transfer device extends past the side limits of the tool. The cross members (37) are preferably not supported at the ends (38, 39) by their transfer units (29 to 32), but at the locations (57, 58) at a distance thereto, thus permitting a higher operating speed.

5 Claims, 11 Drawing Sheets

TRANSFER PRESS WITH IMPROVED USE OF SPACE

CROSS REFERENCE TO RELATED APPLICATIONS

This application claims the priority of German Patent Application No. 103 28 447.8, filed Jun. 25, 2003, the subject matter of which, in its entirety, is incorporated herein by reference.

FIELD OF THE INVENTION

The invention relates to a multistage transfer press for stamped articles, particularly automobile body parts, which comprises a press frame including a plurality of press tables arranged in a row, a plurality of press supports mounted on the tables and a plurality of crown or head pieces on the supports. A plurality of press rams are arranged above the press tables such that they can be moved up and down by a main drive, with each ram and a respective slide table disposed on a respectively associated press table defining one tool accommodation space. At least one tool is arranged in a respective tool accommodation space and comprises an upper tool part that is connected to the associated ram and a lower tool part that is connected to the associated sliding table. At least one transfer unit having a holding device is provided for the temporarily holding and transporting of a work piece along a path from one tool to another tool, with the transfer unit additionally having at least one driving unit that is individually assigned to the holding device.

BACKGROUND OF THE INVENTION

Transfer presses are used for making automobile body parts, for example, or other large-surface sheet metal parts used in the automobile industry. The sheet-metal parts to be produced have widths and lengths of up to several meters and are formed from flat metal sheets in a multi-stage metal-forming process. The sheet-metal part dimensions thus determine the tool dimensions for the various metal-forming stages and the transfer presses are correspondingly large.

U.S. Pat. No. 5,140,839 discloses a transfer press with a press frame, comprising press supports, press tables or press plates and headpieces or crown pieces. Rams that can be moved up and down with a press drive are installed above the press tables. Sliding tables for accommodating tools are assigned to the press tables, with the lower tool being fixedly connected to the sliding table and the upper tool being connected to the press ram. Each sliding table and each press ram carries respectively several tools. A transfer device with suction bridges is provided for transporting the work pieces between the tools, meaning from press stage to press stage. Each suction bridge takes the form of a cross or transverse member provided with suction spiders that function as holding devices. The suction bridges are moved with the aid of lifting and transporting units that are arranged in a narrow intermediate space between the tools and the press support on both sides of the tools, which extend respectively in a longitudinal direction through the press. Pairs of the lifting and transporting units respectively carry one suction bridge with their ends. The length of one suction bridge is longer than the width of a tool, so that the ends of the suction bride project on both sides from the tool if the suction bridge is located inside the tool.

A transfer press, which operates with a suction-transfer system, is also known from reference European Published patent application EP 0388610 A1. In contrast to the above-described transfer press, the transfer press according to EP 0388610 A1 is provided with just one tool below each ram. Running rails for guiding the suction bridges extend on both sides of the tool through the transfer press. The suction bridges project on both ends past the tools and are held on carriages running along rails. Between the press supports and the tools, a considerable amount of space must be provided for the rails, the carriages and the associated units. Conversely, the space spanned by the press supports can be utilized only partially for the existing tools.

A different problem appears when using older tools that were originally provided for the operation of single presses. Tools of this type sometimes are provided with guides that operate between the upper tool and the lower tool and are arranged on the side of the tools. Guides of this type stand in the way of mechanization through a traditional suction transfer.

German published patent application DE 195 21 976 A1 deals extensively with the work piece transport in presses for large parts, wherein press lines with individual presses, arranged at relatively large distances from each other, as well as press lines with presses arranged adjacent to each other are considered. FIG. 38 of the document discloses a hinged-arm feeder for transporting parts from press to press, provided these are set up at relatively short distances to each other. The feeder is provided with a vertically adjustable carrier, e.g., held by means of a guiding device on a cross bridge that connects two press supports. The slide carries a pivot drive that acts upon a crank. The pivoting end of the crank is connected to a suspended lever parallelogram, the upper end of which is guided on a slide so as to be freely displaceable in the vertical direction. The lower end of the lever parallelogram, on the other end, carries two guide rods that are hinged to each other, with one of the guide rods being connected to the parallelogram and the other of the guide rods being connected to a suction spider. A planetary gear is arranged at the lower end of the parallelogram, which translates the pivoting movement of the parallelogram into a pivoting movement of the respective guide rod supported by it. The planetary gear thus causes a forced-motion coupling. The joint connection between the two guide rods, supported by the parallelogram, is positioned by means of a toothed belt that moves the two guide rods of necessity against each other when the parallelogram is pivoted.

For the linear transport movement, the parallelogram pivots from one pivoting end position, in which both guide rods project outward from its lower end, initially into a lower position in which the first guide rod points upward in a perpendicular direction and the second guide rod is suspended from there perpendicular in a downward direction and then moves past this position and into its other extreme position where both guide rods extend in the other direction.

The total energy required for accelerating and decelerating the drive and the sheet metal parts is provided by the crank drive.

In addition, the bridge provided for supporting and positioning the transfer device requires a certain structural space between the supports, which is particularly narrow if the individual press stages of neighboring presses are arranged very close together. In particular, this is true for hybrid press systems where adjacent presses respectively share a common support, with the spacing between the tools of neighboring presses being so narrow that no intermediate repositories are provided between the supports.

Starting with this, it is the object of the present invention to develop a transfer press that permits an improved use of the space between the press stages that is spanned. It is furthermore the object of the invention to design the transfer device such that short transfer times and an exact tool positioning can be achieved.

SUMMARY OF THE INVENTION

Both of the above mentioned objects are achieved according to the present invention by a multi stage transfer press that comprises a press frame with press tables, press supports, and head or crown pieces arranged in a row. Sliding tables are provided on the respective press tables and above these sliding tables, respective rams are positioned so as to move up and down and to be driven by a main press drive or several separate drives. An upper part of a respective tool is carried by the ram, while a lower part of the respective tool is mounted on the sliding table. At least one transfer unit provided with a holding device and at least one drive unit is provided to move a work piece from a tool of one press stage to a tool of an adjacent press stage. The respective driving unit is mounted on at least one crown or head piece between the tools of adjacent press stages.

One embodiment of the transfer press can be configured such that each ram simply carries one tool, wherein it is also possible to have an embodiment where one or several of the rams carry two or more tools. In both cases, it is possible to provide so-called intermediate repositories between one or several of the tools for the intermediate deposit of the work piece between two processing steps (metal-forming steps), or in general omit such intermediate repositories. The intermediate repositories can function to hold the work piece only temporarily, or to change the orientation of the work piece between two forming stages, or to allow additional processing of the work piece, for example laser processing or the like.

Each transfer unit is provided with a cross or transverse member on which holding devices are positioned, for example, suction spiders. The cross members are preferably shorter than a tool width, so that they do not project with their ends from the tool if they are positioned in the tool. As a result, it is possible to mount side guides on the tools, which guide the upper tool on the lower tool. In addition, it is possible to insert existing tools of this type into a corresponding transfer press.

One essential advantage of attaching the transfer units to the head or crown pieces is in the clearly improved use of space. Thus, it is possible to dispense with the clearance spaces between the tools and the press supports, required so far on both sides of the row formed with tools, for accommodating the transfer rods, the guide rails and similar components belonging to the transfer units or devices. The tools can fully use the spanning width of the supports or, vice versa, the spanning width can be reduced to the width of the tools. This increases the rigidity of the head or crown pieces and the press tables, thus making possible an increased processing accuracy of the sheet metal parts with simpler means. The press system furthermore can have a particularly short design in the transporting direction. As a result of the direct suspension of the transfer units from the head or crown pieces, the previously required structural space for possible bridges between the press supports can be omitted. In addition, the press supports can now be used to attach the ram guides. In any case, no space must be reserved on the press supports for any lifting units or supports for lifting units.

The holding devices are carried and moved by driving units, arranged between the processing stages of the press. Each cross member is preferably assigned two driving units which effect the lifting and lowering of same, as well as cause its movement in the transporting direction. The driving units are preferably arranged above the path traversed by the work pieces as it is transported. The driving units on the whole form a modular or cell-type transfer device for which the individual driving units operate asynchronously, meaning offset in time, and can preset different transfer curves.

The holding devices are preferably moved via two-link or multi-link articulated arms or chains, which respectively connect the driving units to the corresponding connection point for the holding device, thus resulting in the advantage that the highest positioning accuracy is achieved near the stretched position of the articulated arms or chains. A rotating drive with predetermined torque at the same time generates the maximum acceleration force and/or deceleration force in these positions, meaning respectively at the start of the acceleration phase and the end of the deceleration phase. In particular the high acceleration in the starting phases of an acceleration phase saves time and thus permits a quick transfer, particularly if the articulated chain is in the target position, meaning if the cross member is approximately in the position of the tool center, where it is stretched completely or almost completely. The stretched position in this case is defined by an obtuse angle of more than 140° between the individual guide rods of the articulated arm or chain.

The precision of the articulated arm or chain can be increased with guide rods or arms of different lengths, wherein the guide rod directly connected to the driving arrangement preferably is slightly longer than the one connected to the holding device.

The joints of the guide rod assembly can be aligned such that they have approximately horizontal rotational axes, but also such that they have vertical rotational axes. The embodiment with horizontal rotational axes is considered particularly advantageous, wherein the transfer device is designed such that the articulated arm or chain reaches the vertical stretched position approximately halfway between the two tools. The necessary lifting unit in that case performs a lifting movement that corresponds approximately to the length of the guide rod assembly. This large lift helps accelerate the metal-forming movement for the work pieces. It has turned out that a considerable share of the lifting device output generated during the upward movement contributes to the acceleration of the work pieces, in the same way as for a centrifugal movement. The deceleration of the work pieces is aided in the same way during the downward movement of the lifting device. Using this effect opens up the way for energetically optimizing the metal-forming movement, with the result that relatively low-capacity drives can be used as pivot drives for the guide assembly while it is still possible to achieve high positioning accuracy and a high transport speed. This is true for the embodiments where a holding device, e.g., suction spider, is moved by a single guide rod assembly, as well as for the tandem or parallel arrangements where the holding device is suspended from a cross or transverse member, which in turn is supported by two more or fewer synchronously operating guide-rod assemblies.

It is also possible to dispense with the cross members and to provide two side-by-side arranged, synchronously operating transfer units with a suction spider, arranged respectively on each end of the guide-rod assembly. This type of arrangement has the advantage that large work pieces can be moved through the joint use of both transfer units or that smaller work pieces, e.g. doors, can be moved side-by-side and independent of each other from tool to tool, thus making it possible to serve dual-purpose tools. Both driving units of a cross member are preferably designed and arranged mirror-symmetrical to a vertical center plane for the press system. Such dual-purpose tools are, for example, tools for producing doors, wherein respectively two doors are produced in one and the same tool. Adjustments where the spacing between doors must be changed during the transport from tool to tool are possible in that case.

Further details of advantageous embodiments of the invention follow from the drawings, which illustrate exemplary embodiments of the invention.

DETAILED DESCRIPTION OF THE INVENTION

Figure 1:
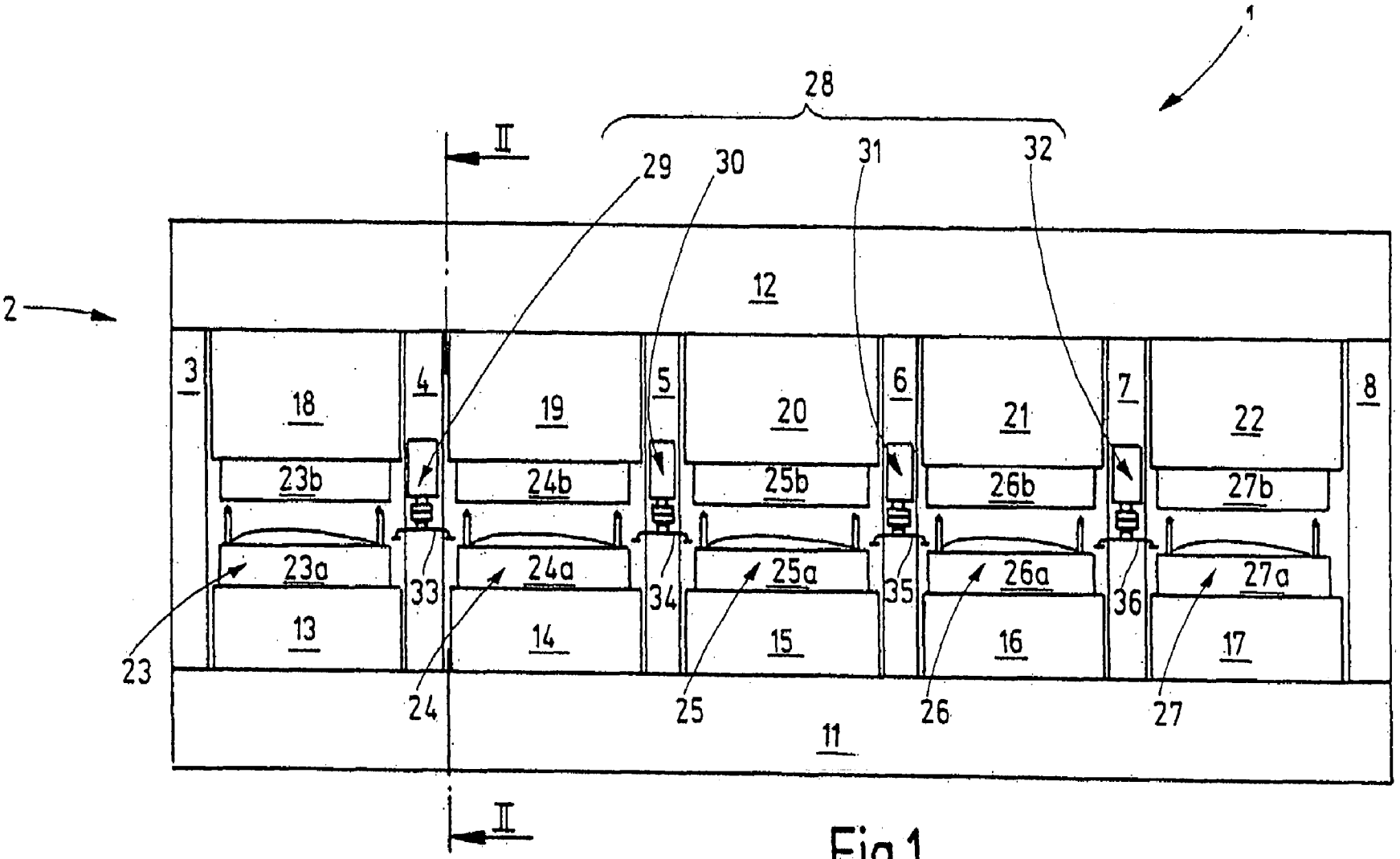
FIG. 1 is a schematic view from the side of a multistage transfer press according to the invention.

FIG. 1 shows a multistage transfer press 1 for which the press frame 2 comprises the press supports 3, 4, 5, 6, 7, 8, 9 (FIG. 2), the press tables 11 and the head or crown pieces 12, with the stages being arranged in a row. The press tables 11 and the headpieces 12 of the respective stages are shown in FIG. 1 as respective continuous structural parts. As a rule, however, they are composed of individual parts that abut in the region of the press supports 3 to 9 or which jointly enclose a narrow gap. Respective sliding tables 13, 14, 15, 16, 17 rest on the press table(s) 11 and can be moved sideways out of the transfer press 1, between the respectively adjacent press supports. Respective press rams 18, 19, 20, 21, 22 for the individual press stages are arranged above the sliding tables 13 to 17, respectively, and are moved up and down by a joint main drive or by individual drives, which either operate the rams individually or in groups. Corresponding ram guides are provided on the press supports 3 to 9, but are not shown in further detail here. Each sliding table 13 to 17 and its associated ram 18 to 22 define between them a space for accommodating a respective press tool 23, 24, 25, 26, 27. Each press tool 23 to 27 is respectively composed of an upper tool part 23*b* –27*b* mounted on the associated ram, and a lower tool part 23*a*–27*a* mounted on the associated sliding table.

A transfer device 28 that comprises the respective transfer units 29 to 32 handles the transport of the work-pieces, for example, involving stamped or stretched out sheet-metal parts. The individual transfer units are arranged respectively between the tools of neighboring or adjacent press stages and serve to transport the sheet metal parts from tool to tool. Intermediate repositories between adjacent tools do not exist with this exemplary embodiment, thus making it possible to achieve an especially narrow spacing between adjacent tools, wherein the distances preferably are shorter than the length of a tool measured in the transporting direction, but longer than the length of a suction spider 33, 34, 35, 36 which functions as a respective holding device for the work-piece.

Figure 2:
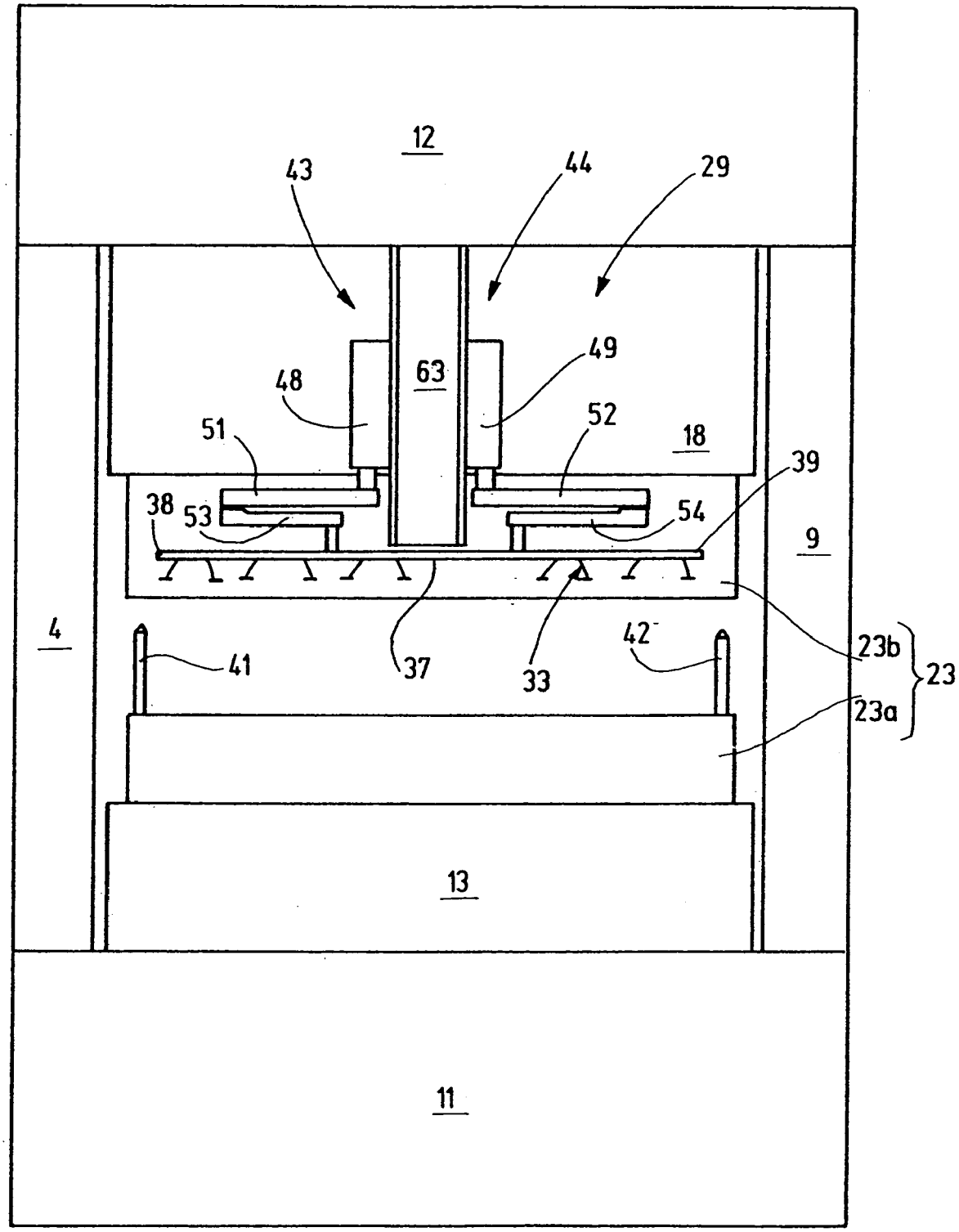
FIG. 2 is a schematic side view of the transfer press according to FIG. 1 in the direction II—II in FIG. 1.

FIG. 2 schematically illustrates a section through the transfer press 1 according to FIG. 1, along the line II—II. The following description of the transfer unit 29 illustrated in FIG. 2 correspondingly applies to all other transfer units 30 to 32. The suction spider 33 is held by a cross member 37 with a shorter length from one end 38 to its other end 39, measured crosswise to the transporting direction, than the width of the upper tool 23*b*, measured in the same direction, or that of the lower tool 23*a*. The length of the cross member 37 additionally is shorter than the clear width between two guides 41, 42, measured in the same direction, which can be provided on both sides of the lower tool 23*a* for guiding the upper tool 23*b* during the closing of the tool 23. The guides 41, 42 can be configured as shown, such that they move out of the upper tool 23*b* when the tool 23 opens up, or they can be engaged continuously. In any case, the length of the cross member 37 is such that it can be moved between the guides 41, 42 in the transport direction.

A respective drive arrangement is assigned to the cross member 37 for its movement within the framework of a transfer movement, which drive includes two drive units 43, 44. The two drive units 43, 44 are configured symmetrically with respect to a vertical center plane 45, shown in FIG. 3. The following description of the drive unit 43 thus also applies correspondingly to the drive unit 44, unless differences are specifically pointed out.

Each of the drive units 43, 44 respectively comprises an articulated arm or chain 46, 47 which serves to connect the cross member 37 to two pivoting drives 48, 49. A respective first leg or arm 51, 52 of the articulated arm or chain is connected to a power takeoff for the respective pivoting drive 48, 49, so that the first leg or arm 51, 52 can rotate around a vertical axis of rotation. At their respective free ends, each first leg or arm 51, 52 is connected with a respective second arm or drive rod 53, 54 via a pivot joint 55, 56, respectively. The rotational axis of each of the joints 55, 56 is oriented parallel to the rotational axes of the pivoting drives 48, 49. Moreover, to increase the precision of the arrangement, the first leg or arm 51, 52 of each articulated arm or chain may be shorter that its associated respective driving rod or arm 53, 54, as shown in the figures.

Figure 3:
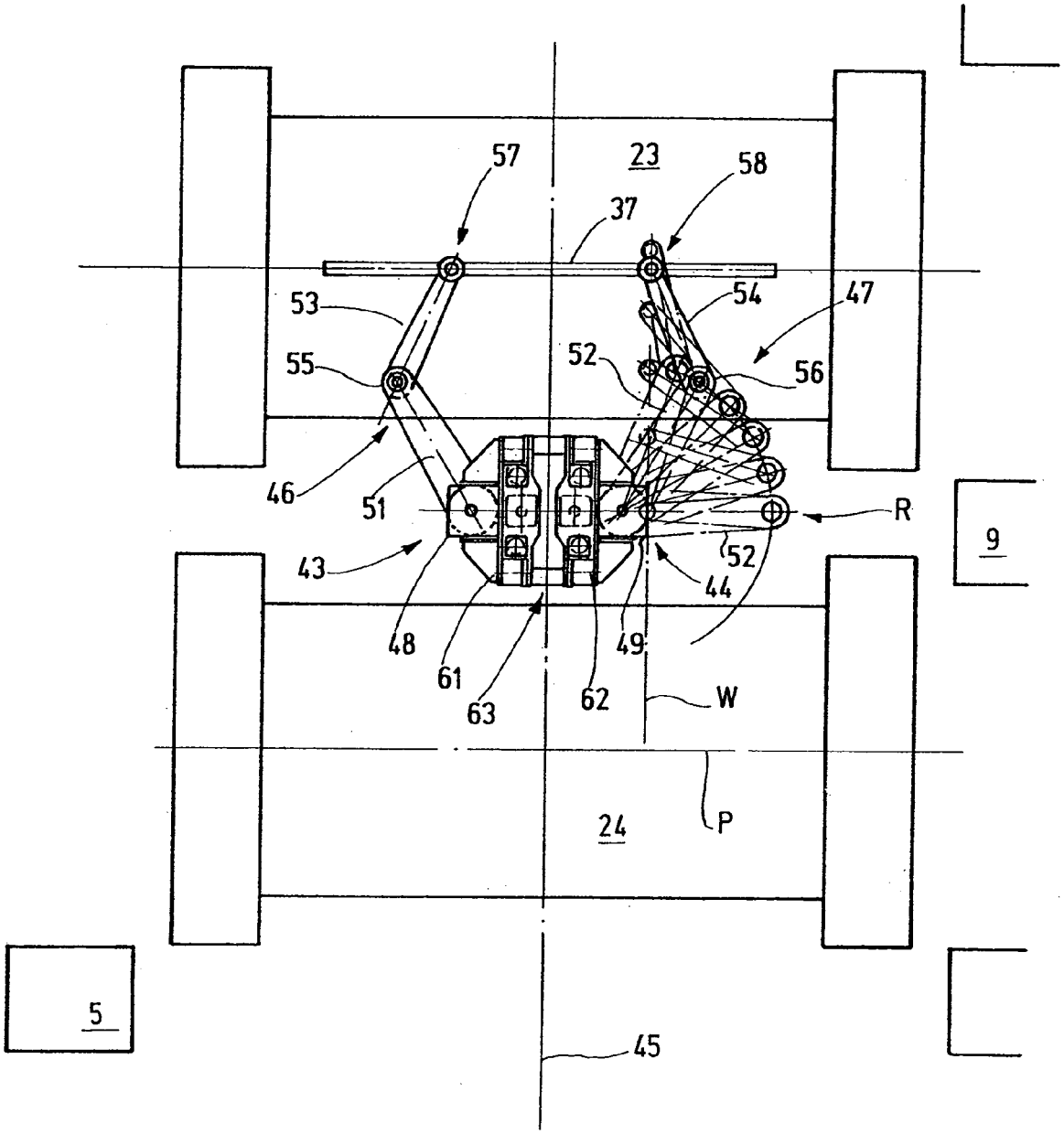
FIG. 3 is a schematic horizontal sectional view of the transfer press according to FIG. 1, showing the details of the transfer device.

The respective ends of the driving rods 53, 54, which are removed from, i.e., not connected to, the joints 55, 56, are connected to the cross member 37 via additional pivot joints 57, 58 whose pivoting or rotational axes are oriented parallel to those of the joints 55, 56, i.e., vertical as shown. As shown, it is preferable that the pivot joints or connections 57, 58 are located at a distance from the respective ends 38, 39 of the cross or transverse member 37. The driving rods 53, 54 together with together with the legs 51, 52 form straight guide paths as shown in FIG. 3 with the aid of articulated chain 47. The pivot joint 58 lies on the straight path W during movement. All transfer units 29 to 32 contain identical pivot joints, or connecting locations, 57, 58, wherein all connecting points 57 are positioned on, i.e., travel along, a straight line or path during movement. In the same way, all joints or connecting points 58 are move along a straight line or path. The two lines or paths extend parallel to each other through all the tools, meaning the cross members 37 are held at or moved tot positions that are located within dimensions of the tool spaces.

The pivot drives 48, 49 mounted via respective slides 61, 62 on a vertical guide 63 for movement in the vertical direction. A lifting drive 64, e.g. shown in FIG. 5, is used to vertically adjust the slides and thus the rotational drives 48, 49 either individually or jointly.

Figure 5:
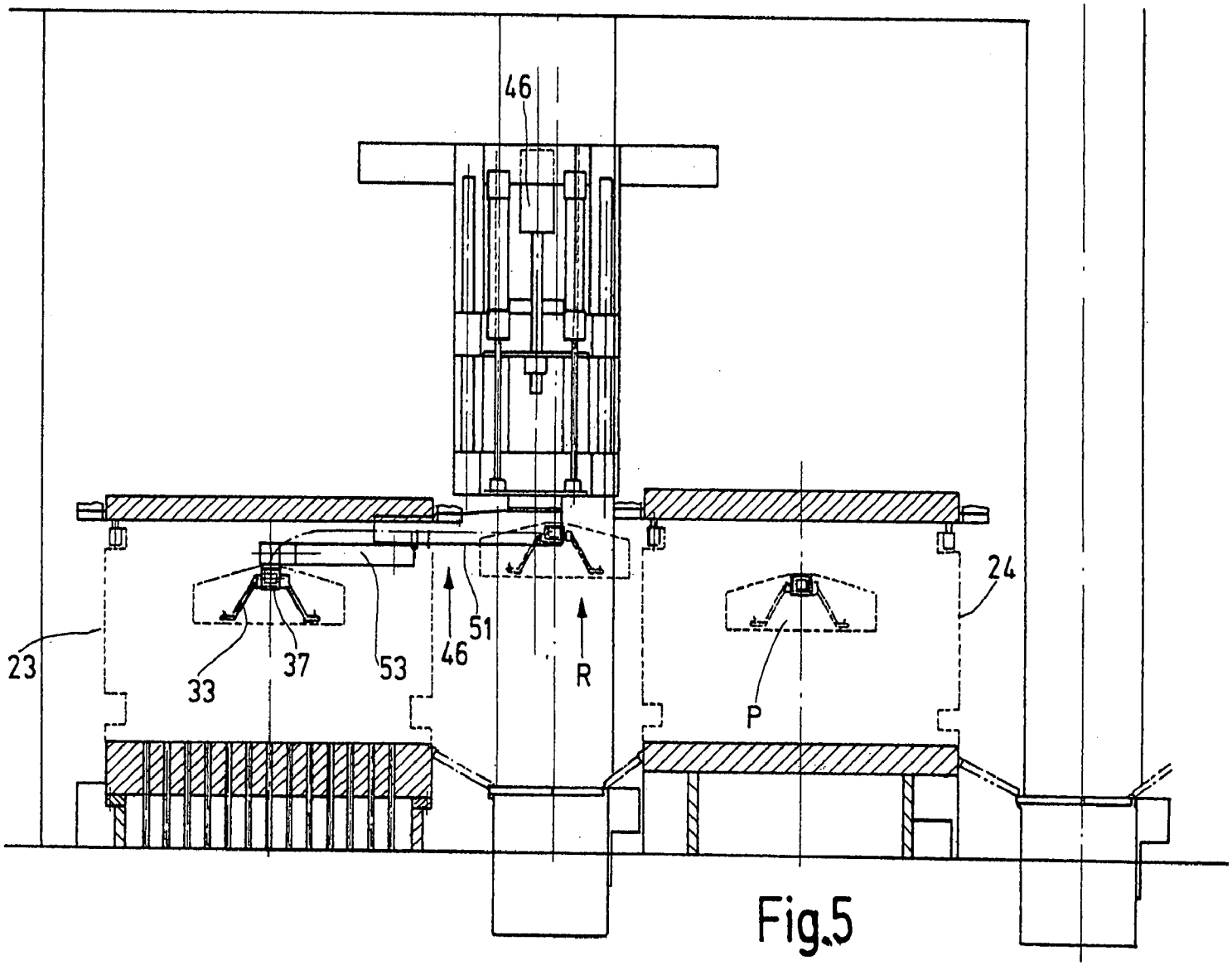
FIG. 5 shows the transfer press according to FIG. 1, in a more detailed, schematic view from the side of the transfer device.

As indicated in FIGS. 2 and 5, the vertical guide 63 is connected to the headpieces 12. In general, the positioning on the headpieces 12, which are subject to being deformed during the operation, does not result in the disadvantage of inaccuracy because the sheet-metal transport, for which the precision is important, takes place while the headpieces 12 are not stressed. However, a considerable advantage is achieved with respect to the use of the space available between the rams or tools. Bridges or similar elements connecting adjacent supports of adjacent press stages at the ram level are therefore not needed. As a result, very small press supports can be used, the inside of which is occupied almost completely by ram guides, thus permitting narrow spacing between rams and shorter distances between tools which in turn results in short transporting steps. The resulting compact press design minimizes deformations of the press and thus meets a higher accuracy for the press with reduced structural expenditure, which additionally results in a considerable cost reduction because the structural expenditure for creating a specified tool space is reduced. Shortening the transport step furthermore permits an increase in the number of cycles.

Figure 4:
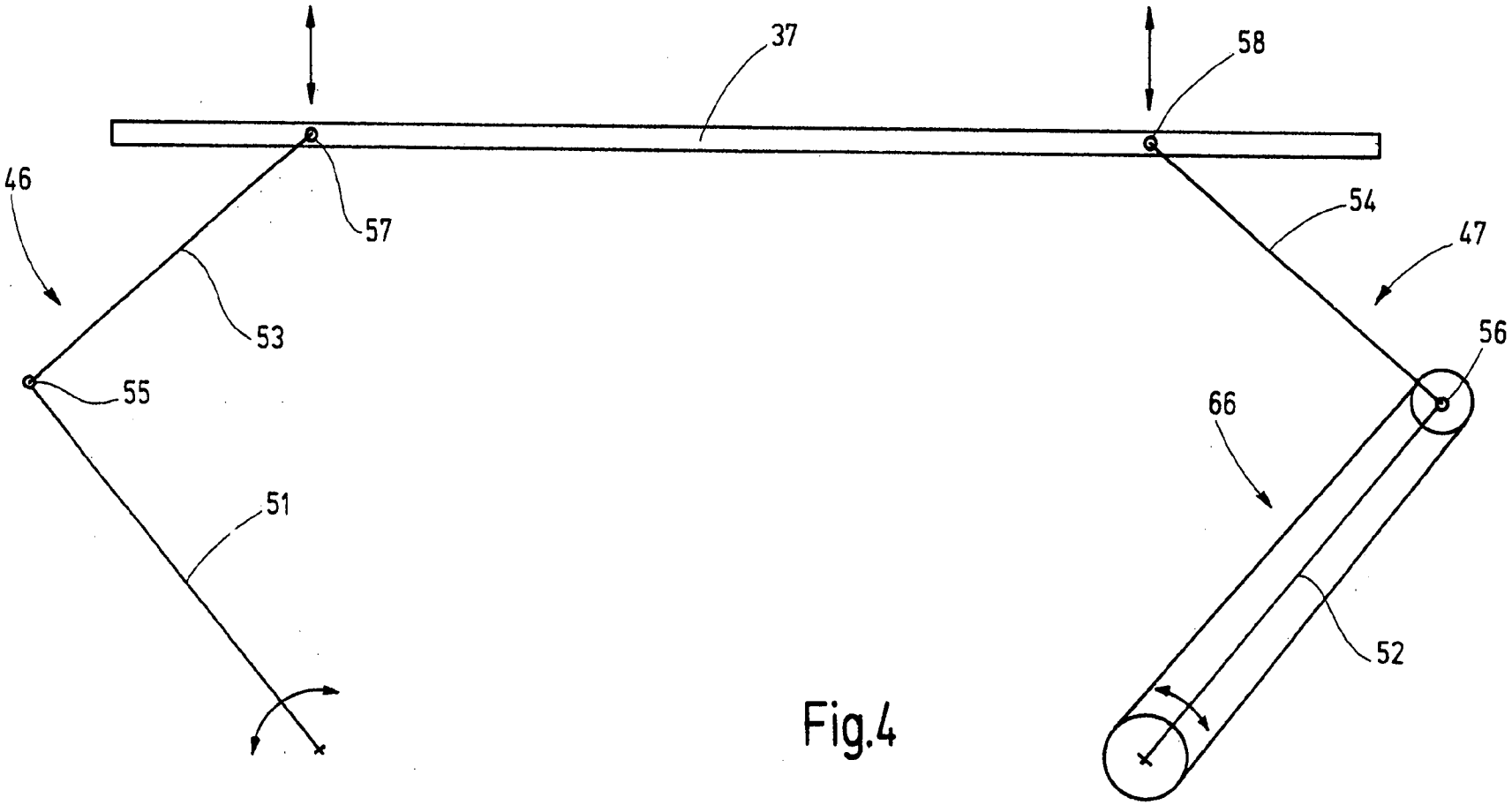
FIG. 4 shows the kinematics for the transfer device of the transfer press according to FIG. 1, in a view from above.

FIG. 4 illustrates the kinematics of the transfer unit 29 and is representative for all other transfer units 30 to 34. The cross member 37 is held by the two articulated arms or chains 46, 47. Both legs 51, 52 are driven or rotated in opposite directions, but with synchronous speed, by the respective pivot drives 48, 49, which are not shown in further detail herein. However, while the joint 55 is not directly connected to a positive drive, the joint 56 is provided with a direct drive, for example, the schematically shown gear arrangement 66, which converts the pivoting movement of the leg 52 to a pivoting movement of the driving rod 54, relative to the leg 52. The translation ratio for the gear arrangement 66 in this case is adjusted such that the joint or connecting location 58 moves along a straight path. The gear arrangement 66 can be a traction gear, a toothed gear, or a similar gear mechanism. In the case of a traction gear, a locally fixed wrap-around wheel (pulley, toothed wheel, gearwheel, articulated chain wheel or the like) can be arranged concentrically to the output shaft of the rotating drive 49, around which a traction element or member, e.g., a chain, is looped. This traction member in turn drives a wrap-around wheel that is connected to the driving rod 54, so as to rotate along. However, it is also possible to provide a separate drive, for example, an electrical and separately controlled drive, for the joint 56. The wrap-around gear can also be a linear gear, if necessary, for which the disks or wheels around which the traction member is looped are positioned eccentrically or which can have a non-round design. In addition, in the case of a separately controlled drive for the joint 56, it is also possible to actuate this drive so as to generate desired curves. As a result, sideways movements of the cross member 37 can be achieved as well.

The straight path W (FIG. 3) is fixed such that it moves at a distance past the rotational axis of the rotational drive 49, which distance corresponds to the length difference between the leg 52 and the driving rod 54. The path W is oriented parallel to the longitudinal center plane 45 and intersects furthermore with the joint or connecting point 58, wherein the same is true for the driving unit 43.

The transfer press 1 described so far operates as follows:

The rams 18 to 22 are moved with the same number of strokes up and down with the aid of a drive that is not shown in further detail herein, either synchronized or offset relative to each other. The tools 23 to 27 thus open and close rhythmically.

The transfer units 29 to 32 serve to move the work pieces from one tool to another, provided the tools are opened. According to the representation in FIG. 5, the pivot drives 48, 49 are initially actuated such that the cross members 37 for the suction spiders 33, in the same way as the cross members and the suction spiders for the other transfer units, respectively move into the upstream positioned tool 33 (as well as 24 to 26). As soon as the suction spider 33 has arrived nearly at the location where it is supposed to pick up the work piece, a lowering movement triggered by a corresponding actuation of the lifting drive 64 is started, wherein the suction spider 33 is activated once it comes to rest on the work piece. The lifting drive 64 is then actuated in the lifting direction and the pivot drives 48, 49 are subsequently activated such that the pivot drive 48 rotates in a counter clockwise direction (FIG. 3) and the pivot drive 49 rotates in a clockwise direction. The nearly stretched-out articulated arms or chains 46, 47 are thus shortened. A high initial force is used for the acceleration of the suction spider holding the work piece if the articulated arms or chains 46, 47 are nearly stretched out. The cross member 37 traverses the straight line path W, wherein the articulated arm or chain 47 passes through the positions shown with dashed lines in FIG. 3. The articulated arm or chain 46 traverses the correspondingly mirrored positions. As soon as the cross member 37 has passed under the rotational drives 48, 49, the articulated chains 46, 47 again start to stretch until the cross member 37 has arrived at a position P of the neighboring tool 24. The articulated chains 46, 47 are then nearly stretched-out again. The work piece is deposited by actuating the lifting drive 64 and the cross member 37 with its suction spider 33 is moved to the idle position. The idle position is a center position between the two tools 23, 24, which is given the reference "R" in FIG. 3. The corresponding positions for the suction spider 33 also follow from FIG. 5.

Figure 6:
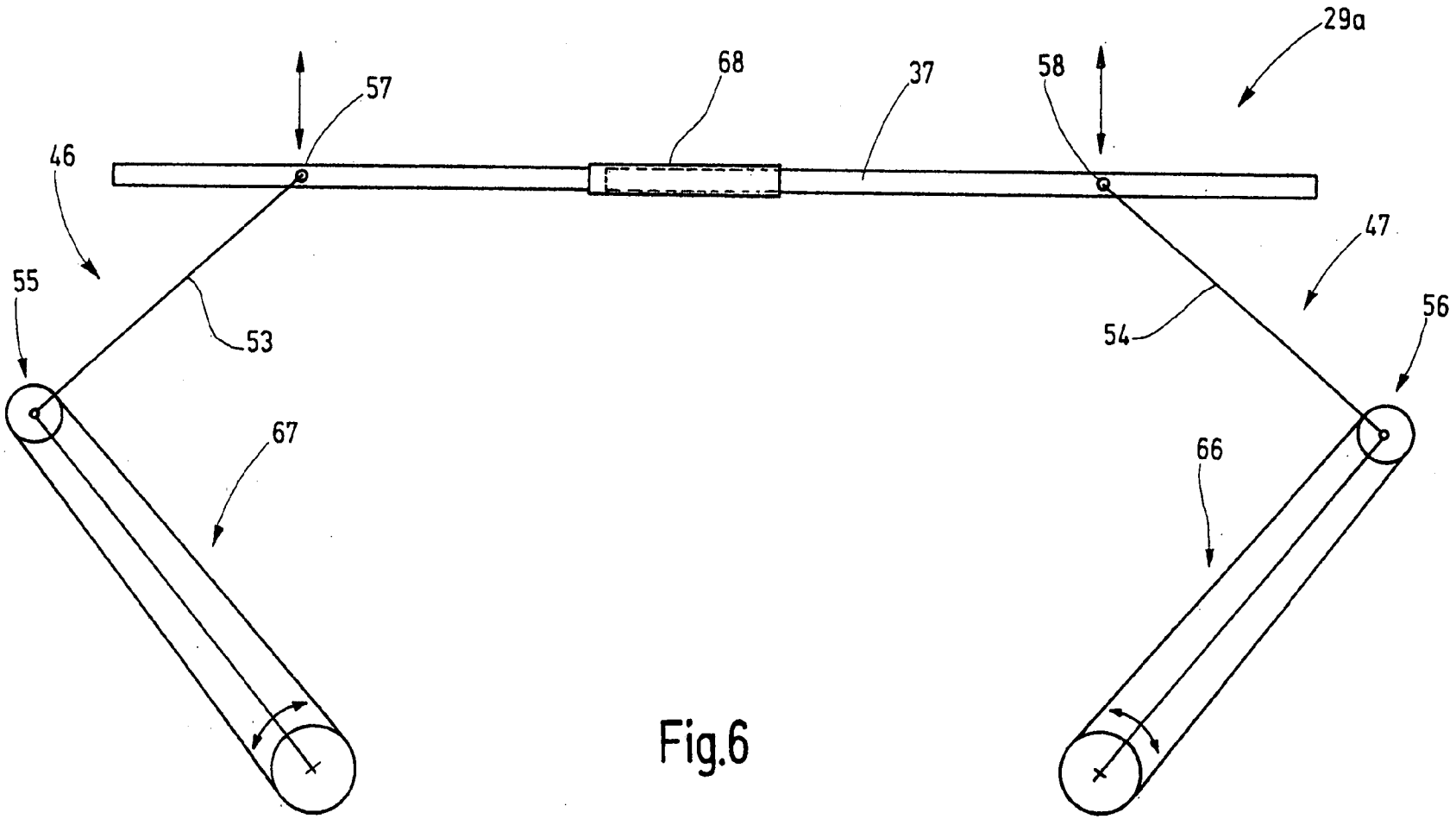
FIG. 6 schematically illustrates a modification of the transfer device according to the invention with a telescoping cross member using a schematic representation of its kinematics.

FIG. 6 shows a modified embodiment of a transfer unit 29 of the transfer device 28. This modified embodiment can be used for one or several of the transfer units of the transfer press 1. First of all, we want to point to the above description, which also applies to the transfer unit 29*a* according to FIG. 6 on the basis of previously introduced reference numbers. Deviating from the above description, the joint 55 is not free but is connected to a different articulated drive formed with a gear arraignment 67, which corresponds completely to the gear arraignment 66 and serves to guide the driving rod 53 in the same manner as the driving rod 54, such that its joint or connecting location 57 moves along a straight path, parallel to the connecting location 58. To avoid a static redundancy in determination and for the tolerance compensation, the cross member 37 can have a telescoping design. In that case, it is provided with a telescoping piece 68 between the joints or connecting locations 57, 58. It is also possible in that case to guide the connecting locations or joints 57, 58 along paths that are not quite straight, e.g., bow-shaped paths. With the embodiment described so far, the paths for the joints or connecting points 57, 58 are derived solely from the pivoting movement of the pivot drives 48, 49. However, it is also possible to provide the joints 55, 56 with separate drives, which are either actuated via a traction member or other gear arrangements 66, 67 or are provided with separate servomotors. With this, relative movements to the side of the two halves of cross member 37, which are separated by the telescoping piece 68, can be carried out in particular in the end positions, meaning when the work pieces are picked up or deposited and the articulated chains 46, 47 are mostly stretched out. If the two halves carry different work pieces, a relative movement between the work pieces can be generated in this manner.

Figure 7:
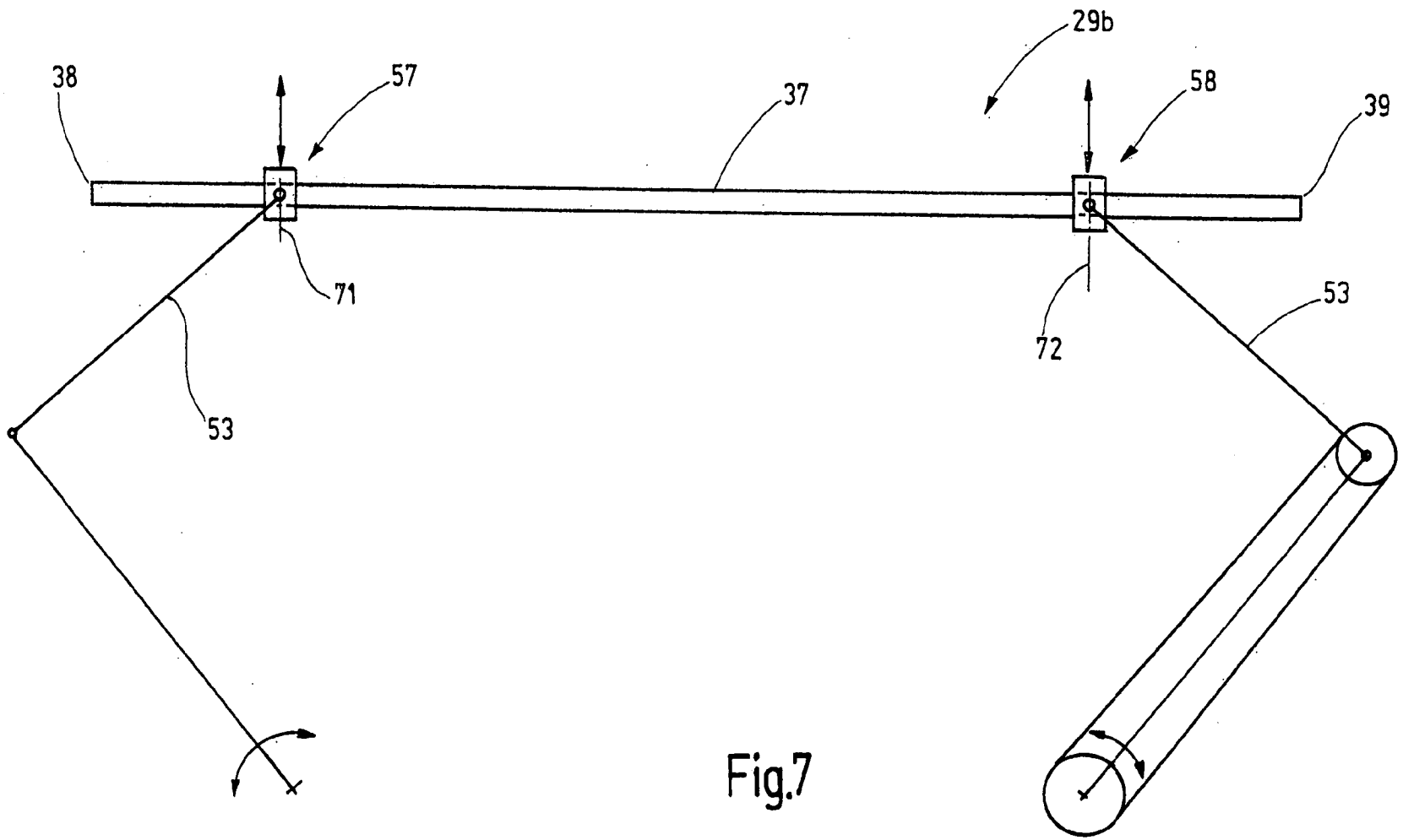
FIG. 7 illustrates a further different embodiment of a transfer device according to the invention, shown with the aid of a schematic representation of its kinematics.

A further modified embodiment 29*b* of the transfer unit is shown in FIG. 7 and can be based on the kinematics according to FIG. 4 or alternatively also on the kinematics according to FIG. 6. It proceeds on the assumption that the two pivot drives 48, 49 can have separate height adjustments, wherein the lifting drive 64, for example, is designed in two parts for this. Thus, the cross member 37 can tilt over one longitudinal direction, meaning while one end 38 is lifted up, the end 39 can be lowered or vice versa. To permit this pivoting movement, the driving rods 53, 54 are not only connected to the cross member 37 so as to pivot around a vertical axis, but additionally also around respective horizontal axes 71, 72, that are oriented parallel to the transporting direction. Two-axis joints are therefore provided at the connecting locations or joints 57, 58. The slanted position of the parts during the transport or during the deposit or pickup of the parts can thus be changed. It is furthermore possible to provide the cross members 37 with respective drives, not shown in FIGS. 4, 6 or 7, that pivot the respective suction spiders, around the longitudinal axis of the respective cross member 37 for changing the positioning of the work piece during the transport.

As previously mentioned, the aforementioned transfer units 29, 29*a*, 29*b* permit a better use of space because they are suspended from a single crown or head piece or from the two crows or head pieces of adjacent press stages. However, they also suffer from certain disadvantages that result from the basic concept. The bearings for the pivot drives 48, 49 as well as the joints 55, 56 are subject to bending stresses, which can be critical with respect to configuration. In addition, the joints 55, 56 in particular perform a rotation of nearly 360° during the transfer lift, which is a disadvantage with respect to the feeding of the mediums, such as compressed air or electrical energy, as well for the possible transmission of sensor signals. Moreover, the total output for accelerating and decelerating the work pieces is generated by the pivot drives 48, 49, which is why these drives must be unreasonably large. For that reason, the improved embodiment of the transfer press shown in FIGS. 8 to 11 is presently considered the most favorable solution.

Figure 8:
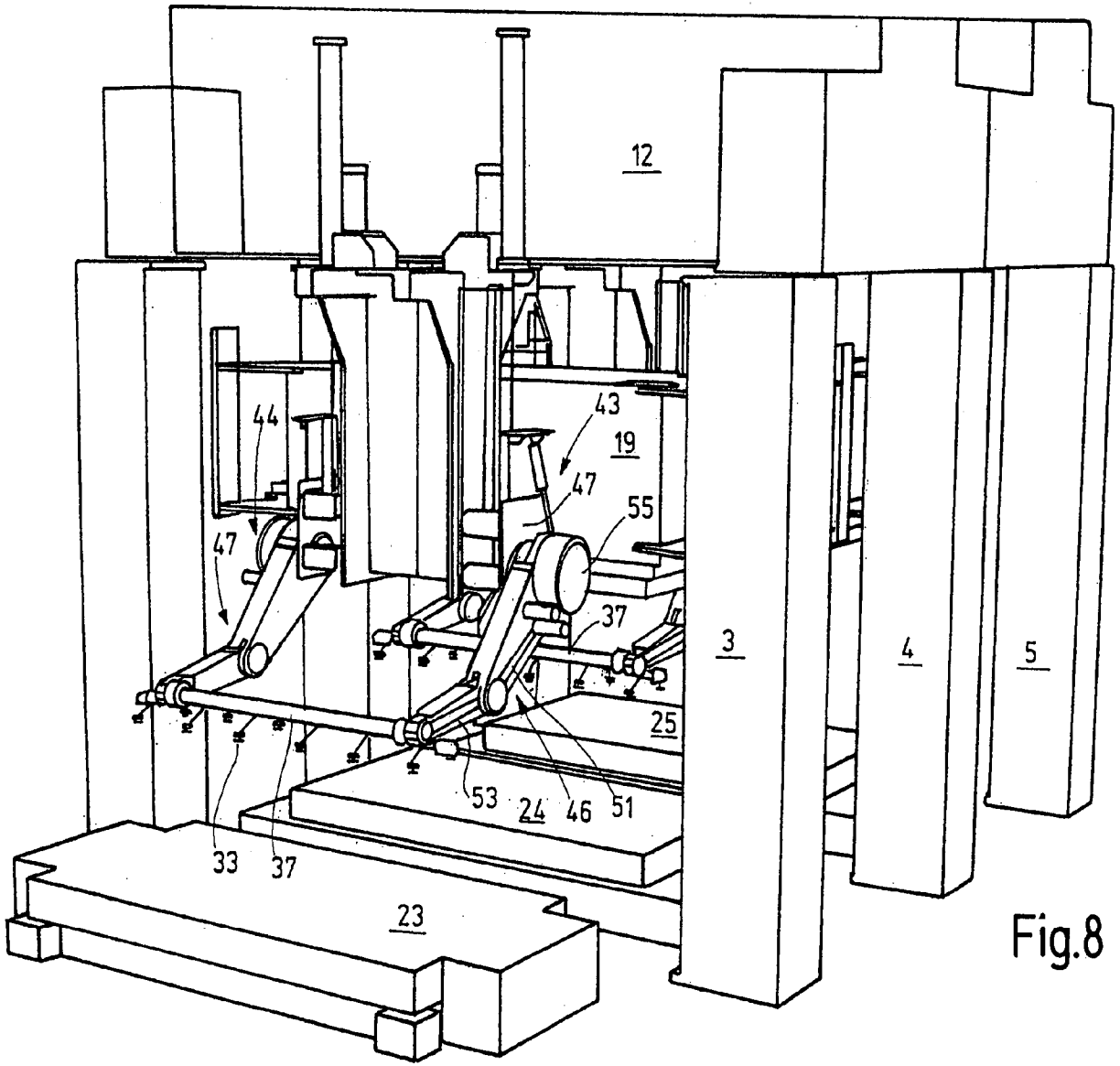
FIG. 8 is a perspective view of a multistage transfer press with a preferred embodiment of a transfer device according to the invention.
Figure 9:
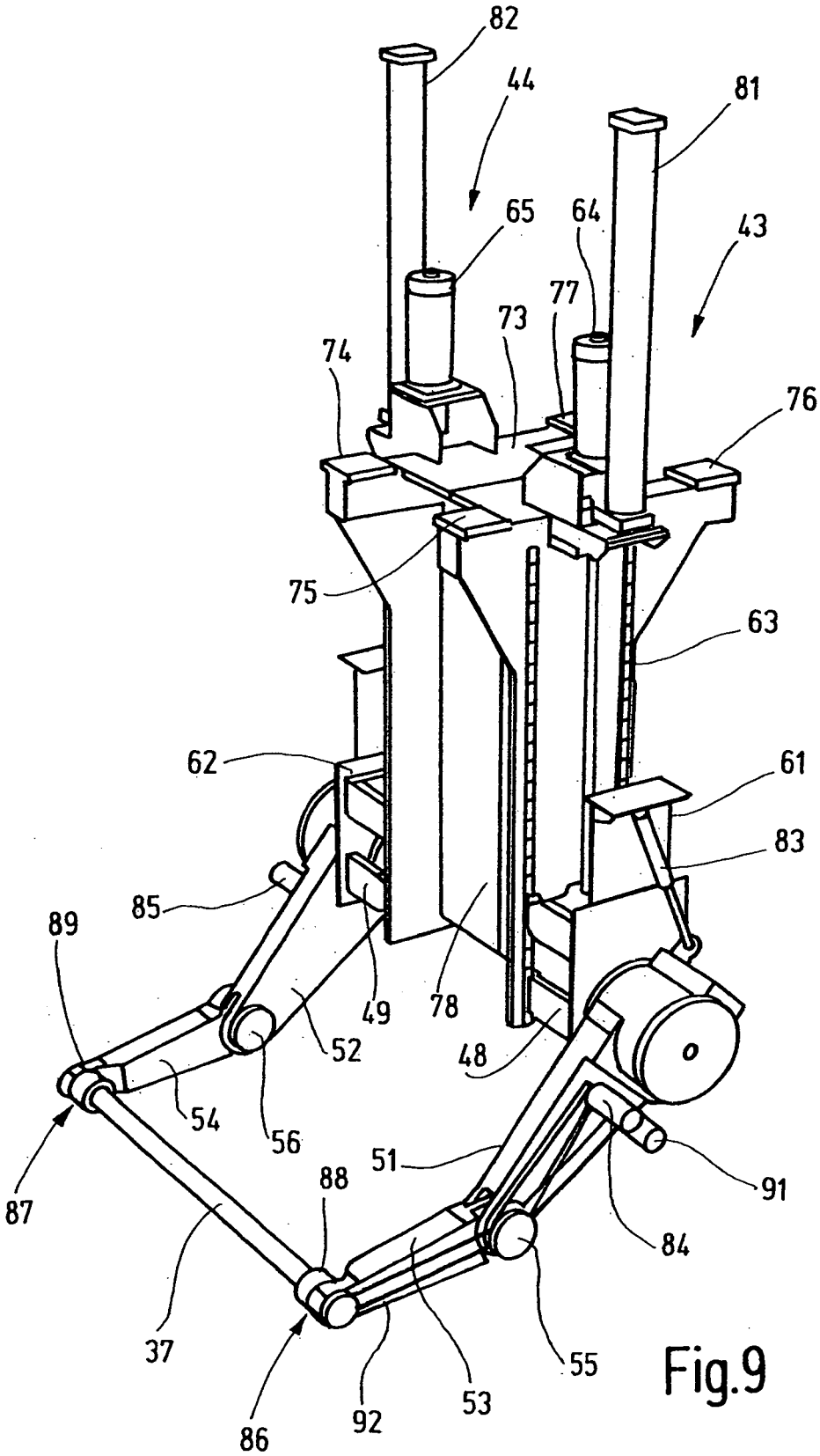
FIG. 9 is a perspective view of the transfer device according to the invention for the transfer press according to FIG. 8 in part with the covers removed.
Figure 10:
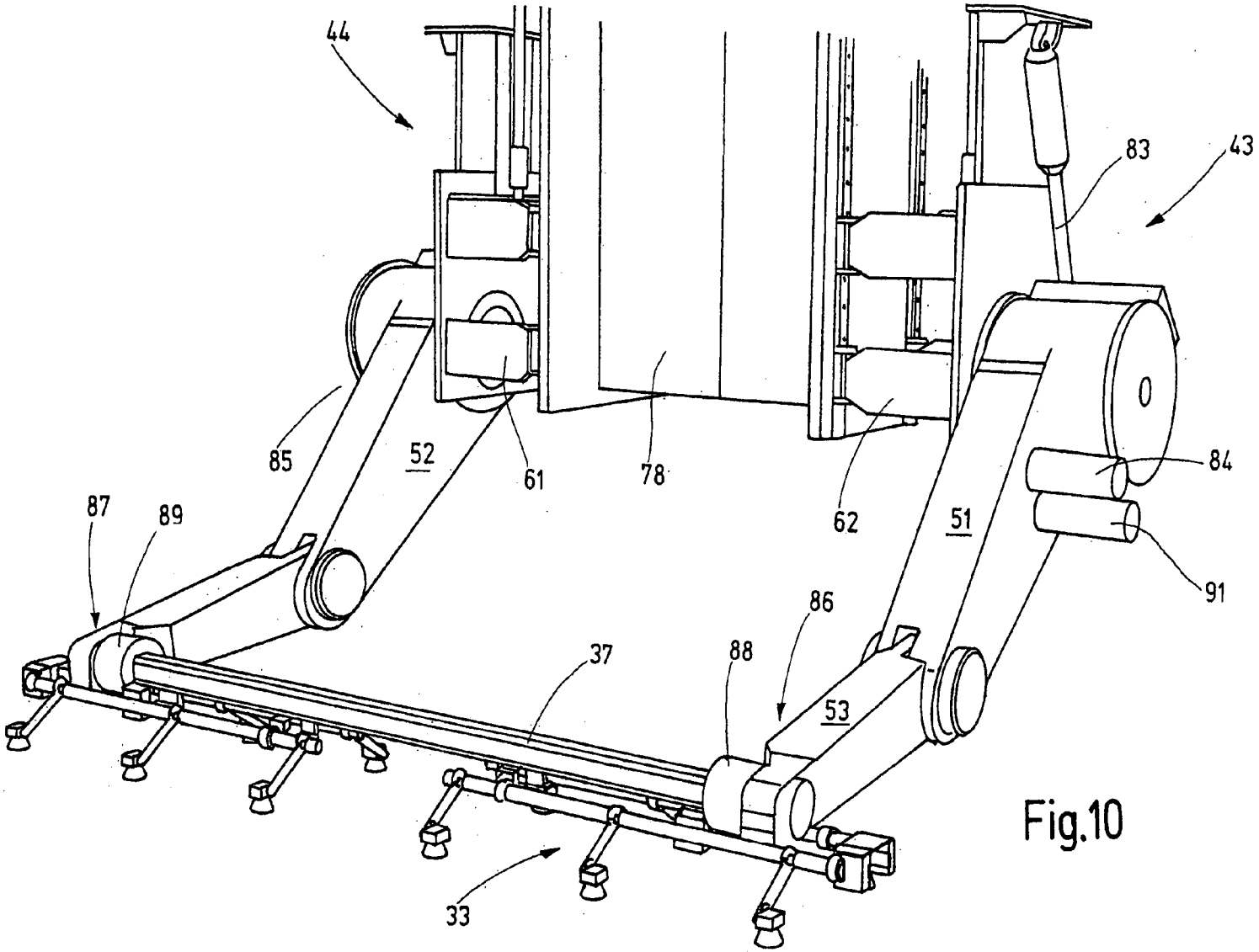
FIG. 10 is a further perspective view, at a larger scale, of a portion of the transfer unit of the transfer system shown in FIG. 9.
Figure 11:
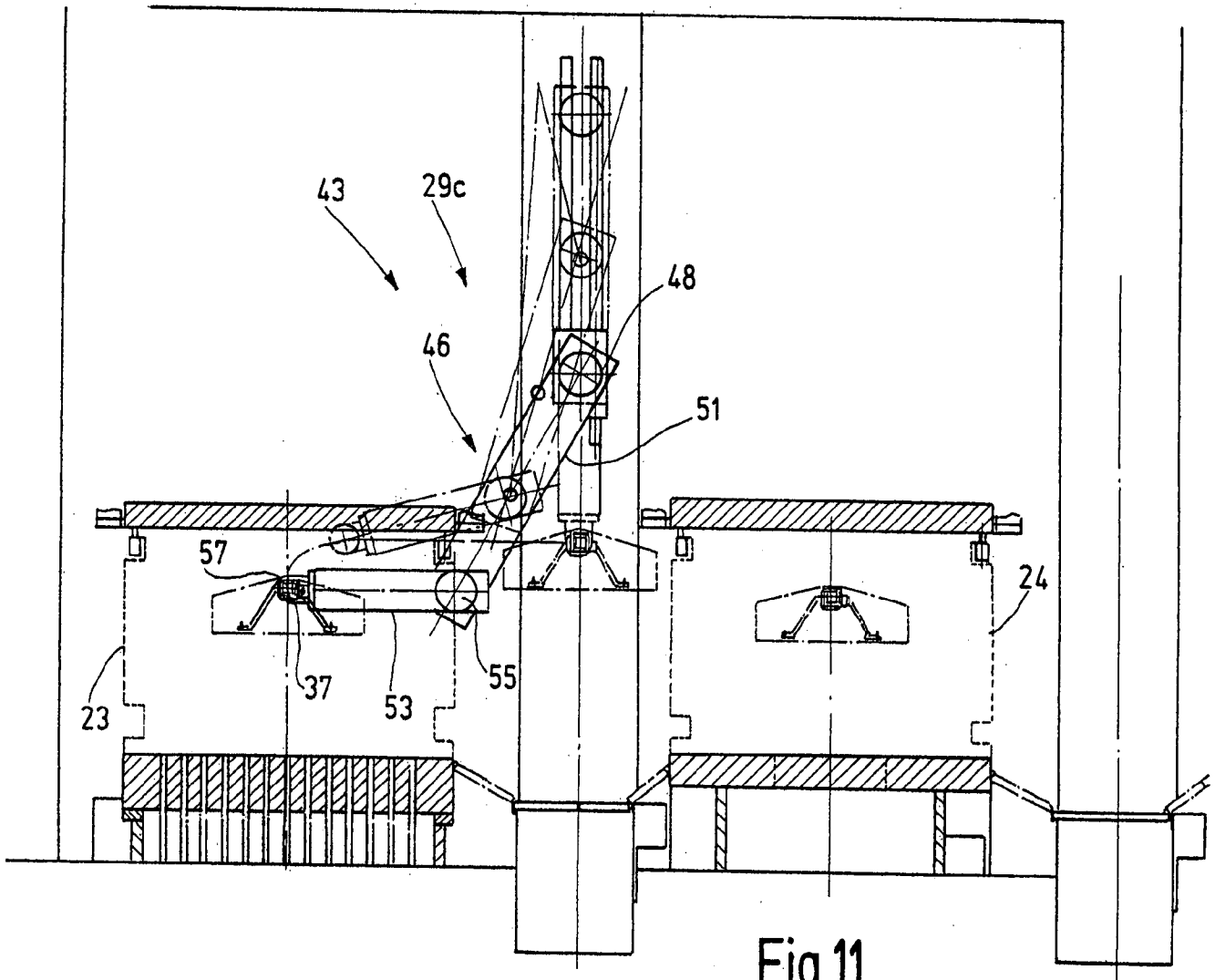
FIG. 11 is a schematic illustration of the transfer press according to FIG. 8 from the side showing different operating phases.

The transfer unit 29*c* according to FIG. 8 and the above-described transfer units have in common that the cross member 37 is held by one or several articulated arms or chains 46, 47 that extend through or into the tool opening pointing in or counter to the transport direction of the respective tool 23, 24 (see FIG. 11). The articulated arm or chain 46 again consists of at least two elements, namely the leg or arm 51 and the driving rod or arm 53. Both are illustrated in FIG. 11 in two different pivoting positions. In this embodiment, and contrary to the previously described embodiments, the articulated axle for joint 55 is oriented horizontally as is the rotational axis for the rotational drive 48. In the same way, the driving rod 53 is connected at the joint or connecting location 57 to the cross member 37 such that it can be pivoted horizontally along with it. The relative pivoting position in this case is realized with a gear or adjustment drive, wherein the same is true for the joint 55. The driving unit 44 is for the most part covered in FIG. 8. However, it is configured in the same manner as the driving unit 43. FIG. 9 shows the design of the driving units 43, 44.

As shown in FIG. 9, a central holder 73 is provided at its upper end with fastening pedestals or bases 74, 75, 76, 77, which can be screwed to adjacent crown or head pieces. The holder 73 in this case bridges a distance between the adjacent head pieces. An extension member 78 projects vertically downward from the central holder 73 and supports the vertical guides 63 for both driving units 43, 44. FIG. 9 only shows the vertical guide 63 of the driving unit 43. The two slides 61, 62, which are mounted to be vertically displaceable, are assigned to the respective lifting drives 64, 65 that cause the lifting and lowering of the slides 61, 62, for example, via threaded spindles. In addition, weight balancing devices 81, 82, e.g., in the form of pneumatic cylinders having piston rods that are connected to the slides 61, 62, are provided directly adjacent to the lifting drives 64, 65. These slides 61, 62 support the pivot drives 48, 49 that respectively determine a horizontal rotational axis oriented transverse to the transporting direction. The output of the drives 48, 49 are connected to the respective legs 51, 52, which can perform a pivoting movement, e.g., of 150° or even up to 180°. In turn, these can be connected to a weight-balancing device, for example, in the form of a pneumatic cylinder 83. This cylinder 83 is hinged to a point vertically above the pivoting axis, and is connected with its piston rod to an extension that extends diametrically outward from the leg 51. The torque generated by the pneumatic cylinder 83 thus counteracts the weight moment of leg 51.

At the free end of leg 51 and/or 52, the driving rods 53, 54 are connected via the joints 55, 56. The pivoting axes of joints 55, 56 in this case extend respectively parallel to the pivoting axes of the pivot drives 48, 49 as well as parallel to each other. The driving rods 53, 54 are actively pivoted with the aid of pivot drives 84, 85, e.g., in the form of electric motors (servo-motors), which are connected to the driving rods 53, 54 via a traction device or member. The pivot drives 84, 85 are preferably arranged near the pivoting center of legs 51, 52.

The cross member 37 is held on the free ends of driving rods 53, 54 with the aid of bearing arrangements 86, 87 that permit a turning of the cross member 37 around its longitudinal axis. This longitudinal axis is essentially oriented parallel to the pivoting axes of joints 55, 56 as well as the pivot drives 48, 49. The cross member 37 is preferably held with its ends inside couplings 88, 89 and is connected to these couplings so as to rotate along. The couplings, which are positioned rotating with the aid of the bearing arrangements 86, 87, can be rotated, e.g., by means of servomotors, wherein FIG. 9 shows only the servomotor 91. This motor is arranged beside the pivot drive 84 and is connected via a traction arrangement 92 or other type of force-transmission device to the coupling 86 and thus to the cross member 37.

The other coupling 87 is positioned freely rotating and can be connected as needed to a servomotor.

The bearing arrangements 86, 87 can be simple radial bearings, or they can also be designed as pivot or self-aligning bearings that permit a certain tumbling movement of their rotational axes. As a result, additional degrees of freedom are opened up with respect to the work piece positioning since a corresponding actuation of the driving arrangements 43, 44 not only permits a parallel transfer of the work pieces, but also makes it possible to orient the work pieces. Independent of this, each driving arrangement 43, 44 only requires three joints, thus causing not only a structural simplification as compared to traditional transfer devices, but also represents an essential improvement in the positioning accuracy.

The different operating positions of the transfer units 29*c* are shown in FIG. 11. While the required vertical lift for the transfer units 29, 29*a*, 29*b* is limited to the lifting stroke of the transfer curve, an additional lift must be traversed with the transfer unit according to FIGS. 8 to 11 to guide the work piece along an essentially straight path from the tool 23 to the tool 24. The output generated by the lifting drives 64, 65 is converted to transporting capacity. If the articulated link chain according to FIG. 9 or 11 moves from the left to the right, the lifting of the slides 61, 62 stimulates its vertical movement in the manner of swinging pendulum. With this, the pivot drives 48, 49 as well as the pivot drives 84, 85 are energetically supported. The lifting drives 64, 65 are arranged locally fixed and therefore can be designed for high performance, without worsening the dynamic of the drive.

Furthermore, a work piece orientation around the cross member axis is possible with only three links in each articulated chain and/or three axes of rotation, thus making intermediate repositories unnecessary. If the bearing arrangements 86, 87 additionally permit tumbling movements, a complete work piece orientation is possible. The work pieces in that case can be pivoted around the longitudinal axis and the vertical axis. This is true at least if the two lifting drives 64, 65 can be activated independent of each other. If these options are not used, the lifting drives 64, 65 and the pivot drives 48, 49 can be combined.

FIG. 11 shows that degrees of freedom are provided for designing the movement curve. This follows from the fact that one and the same curve point can be reached with different positions of the link articulated chain, thus opening up the degree of freedom of suitably distributing the driving capacity to be generated (acceleration and deceleration capacity) to the existing pivot drives through a corresponding configuration of the movement curve for the link articulated chain (with specified transfer curve). One and the same transfer curve can be obtained with different adjustment movements of the articulated drives and the lifting drive. This opens up the way for a speed-optimized transfer.

It is advantageous if the joints are not subject to bending stresses.

It will be appreciated that the above description of the present invention is susceptible to various modifications, changes and adaptations, and the same are intended to be comprehended within the meaning and range of equivalents of the appended claims.

What is claimed is:

1. A multistage transfer press for stamped body parts, said transfer press comprising:

a press frame including a plurality of press stages arranged in a row, with each stage including a press table, press supports mounted on the press table and a crown piece mounted on the press supports, a respective press ram mounted in the frame above a respective press table, such that the press rams of the respective stages can be moved up and down by a main drive, with each press ram and a respective sliding table arranged on the associated respective press table defining a respective tool accommodation space there-between;

a respective tool arranged in each tool accommodation space and each comprising an upper tool part connected to the associated respective ram and a lower tool part connected to the associated respective sliding table; and, at least one transfer unit provided with a holding device for the temporary holding and transporting of a work piece on a path from the tool of one press stage to the tool of an adjacent press stage, with each transfer unit including at least one driving unit that is individually assigned to the holding device, and a multi-part articulated arm with a first leg and a second driving rod that are mutually connected at respective ends by a joint having a horizontal pivoting axis, and with an opposite end of the second driving rod being connected to and supporting the holding device and an opposite end of the first leg being connected to the driving unit for pivoting movement about a horizontal pivot axis; and wherein a respective separate individually activated pivot drive unit is provided on a respective first leg for pivoting the respectively connected second driving rod, and the driving unit for the first leg and the pivot drive for the associated second driving rod are arranged to cause the first leg and the associated second drive rod to pivot in the same pivot direction during a transfer operation.

2. The transfer press according to claim 1, wherein the driving unit is mounted on a vertically displaceable slide that is positioned on a vertically oriented guide to permit vertical movement of the drive unit during a transfer operation.

3. The transfer press according to claim 1, wherein: said holding device includes a cross member extending transverse to a direction of said path; transfer unit includes two of said drive units with connected respective multi-part articulated arms that are symmetrically disposed with the respective said opposite end of each said second driving arm being connected to a respective end of said cross member; and the respective driving units and pivot drives cause both of the first legs and both of the second driving rods to pivot in the same pivot direction during a transfer operation.

4. The transfer press according to claim 3, wherein each of the driving units is mounted on a respective vertically displaceable slide that is positioned on a respective vertically oriented guide to permit vertical movement of the drive units during a transfer operation.

5. The transfer press according to claim 1, wherein a respective transfer unit is provided for each press stage and is arranged between press rams of two adjacent press stages.

* * * * *